United States Patent [19]

Conrad

[11] Patent Number: 4,708,080

[45] Date of Patent: Nov. 24, 1987

[54] COMPOSITE THREAD LINE SAILS

[75] Inventor: Peter G. Conrad, Old Lyme, Conn.

[73] Assignee: Sobstad Sailmakers, Inc., Old Saybrook, Conn.

[21] Appl. No.: 873,188

[22] Filed: Jun. 11, 1986

[51] Int. Cl.[4] ..... B63H 9/06

[52] U.S. Cl. ..... 114/103; 114/113; 428/293; 428/294

[58] Field of Search ..... 114/103, 102, 39, 108, 114/109, 113, 114, 115; 428/292, 293, 294, 295, 246, 284, 287, 253

[56] References Cited

U.S. PATENT DOCUMENTS

| | | | |
|---|---|---|---|
| 3,903,826 | 9/1975 | Andersen | 114/103 |
| 4,444,822 | 4/1984 | Doyle et al. | 428/253 X |
| 4,476,799 | 10/1984 | Bandy | 114/103 |
| 4,499,842 | 2/1985 | Mahr | 114/103 |
| 4,554,205 | 11/1985 | Mahr | 428/246 X |
| 4,593,639 | 6/1986 | Conrad | 114/103 |
| 4,624,205 | 11/1986 | Conrad | 114/103 |

FOREIGN PATENT DOCUMENTS

| | | | |
|---|---|---|---|
| 126614 | 11/1984 | European Pat. Off. | 114/103 |
| 154773 | 9/1985 | European Pat. Off. | 114/103 |
| 2540459 | 8/1984 | France | 114/103 |

OTHER PUBLICATIONS

Bob Bainbridge, "Mylar Developments May Affect Sailcloth Technology", Industrial Fabric Products Review, vol. 59, 5/1982, pp. 61–63.

John Stansell, "The America's Cup-Grand Prix Yachting", New Scientist, No. 1362, 6/1983, pp. 770–775.

"Bonding Replaces Stitching on Racing Mainsails", Industrial Fabric Products Review, vol. 60, No. 11, 3/1984, p. 6.

Greg Pechman, "American Sail Market-Headed For Stormy Weather?", Industrial Fabric Products Review, vol. 62, No. 1, 5/1985, pp. 39–40.

*Primary Examiner*—Joseph F. Peters, Jr.
*Assistant Examiner*—Paul E. Salmon
*Attorney, Agent, or Firm*—Fred A. Keire

[57] ABSTRACT

Sails made with threads running in the direction of principal stresses in a laminate made of the threads laminated to a film material, such as Mylar.

17 Claims, 15 Drawing Figures

FIG. 1
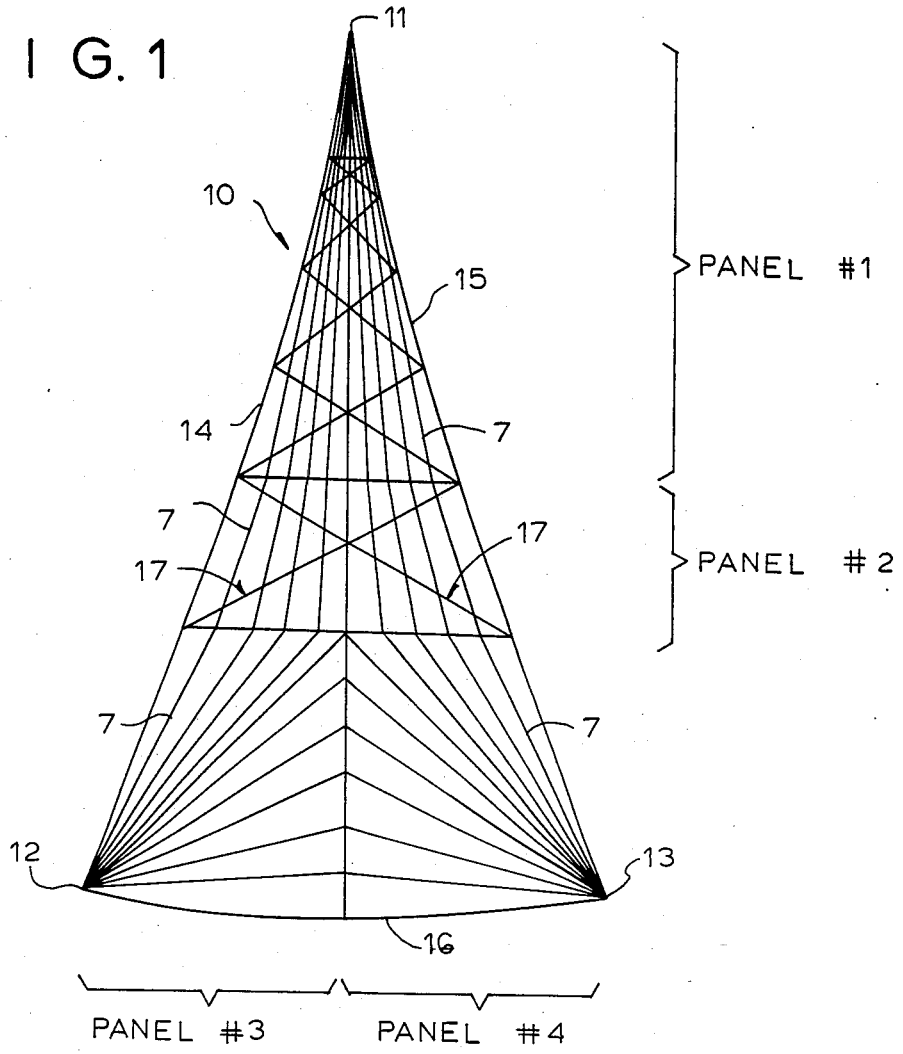
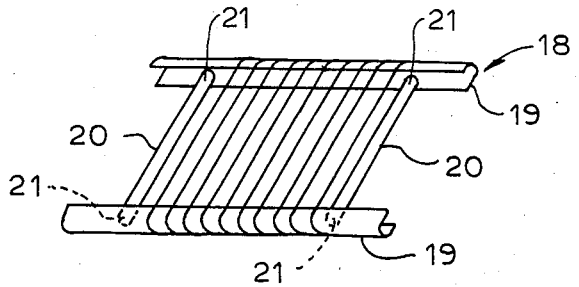
FIG. 2
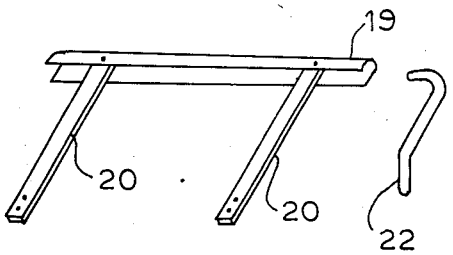
FIG. 2a
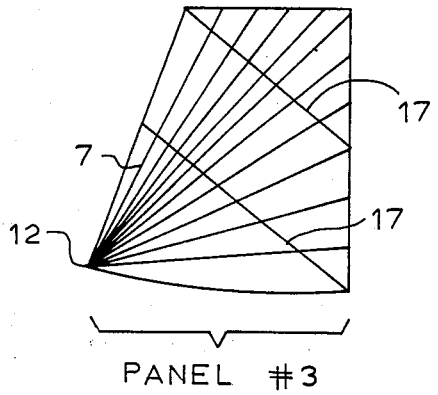
FIG. 3

COMPOSITE THREAD LINE SAILS

This invention relates to sails. More particularly, this invention relates to composite sails where the warp and weft technology is not being used, but instead threads are being used as the principal force bearing means. Still further, the threads as used are disposed in a laminate which may be a Mylar film on one or both sides or a Mylar and light woven material combination for thread confinement.

Still further, these force bearing threads, as used, may be disposed in panel arrangements where each of the individual panels are then incorporated in the desired airfoil shape suitable for a sail. Thus, the entire sail may be made in one, two, or a plurality of panels.

Additionally, this invention relates to a combination of thread line oriented laminates with structural members incorporated in the laminate either before the laminating process during which the threads are incorporated in the composite or after the threads have been incorporated in the composite. These structural members are also suitably disposed on the surface of the panels or the sail itself.

BRIEF DISCUSSION OF PRIOR ART

Typically, a prior art sail has been made by using woven material in various panel layouts. The woven material then has borne entirely the load when the sail has been subjected to stress loading. In order to improve the load bearing of the sail, these woven materials have also been sought to be aligned along the major force lines so that the load by the warp threads would approximate the principal stress orientations in a sailcloth. This stress orientation has been principally for the purpose of avoiding bias loss, and also the warp threads are considerably more capable of bearing the stresses than the weft threads. However, in cutting the panels to approximate these principal force lines, the proper orientation, despite its complicated and sophisticated approaches, is not achievable, and the threads, such as the warp threads, end at the edge of the panels without being able to follow the force lines for any significant distance. It is generally said that the warp threads "run off" the cloth.

Still further, for a woven material using a warp and weft technology, the over and under shape imparted to the threads introduces considerable potential for distention and weakness, e.g., for Kevlar materials. Although a number of steps have beenb used, such as to resinate the material, calender it under heat conditions to stabilize the cloth, or weave the material extremely tightly (to where it has an appearance of paper and the like), the weaving limitations are such that there is considerable waste in the material being woven and then cut to fit into the various panels. There is also considerable waste in the weight per given unit area of the threads that carry the actual load or conversely, the number of threads that carry the actual load versus the total threads in the woven material. There is, of course, a normal waste associated with the weft threads that must be used in weaving. The various methods for stabilizing, such as shrinking, resinating, heat calendering, and the like, introduce process steps which are all either labor or capital-intensive. Accordingly, the sails are often made in such a manner that the panel width is very narrow for the woven material so as to eliminate, as much as possible, the bias behavior of the material when it is subjected to stress in the use of the sail, such as when the sail is loaded heavily, e.g., when the boat is beating to windward.

Some of the problems encountered with the bias distention of the sails have been addressed for considerable time. Thus, various weaves have been used, such as "triaxial weaves", or three layers of the sail have been laminated where each of the material follows a principal direction along the warp thread line. Additionally, laminated sails where a scrim is being used and a scrim is then anchored with a knit type of weave, i.e., cross members to arrest the bias load have also been used, such as shown in U.S. Pat. No. 4,444,822 to Doyle et al. Further, triple-layered heavy materials which are as a result of the lamination and/or materials employed have been disclosed in U.S. Pat. No. 3,903,826 to Anderson.

Further, in my previous application Ser. No. 06/681,933, now U.S. Pat. No. 4,593,639, issued June 10, 1986, I sought to address the problem of the skin bearing the entire load, including the point loads in the sail. I used a combination of skin membranes or skin components of the sail together with a structure for the sail. This "structure and skin" combination sail has been used with great success in bearing the point loads as well as the aerodynamic loads. My previous patent represents a technology that has found wide acceptance and has been extensively copied. The work carried out on that development has generated further developments and inventions, such as shown in my other patent application Ser. No. 06/722,268, now U.S. Pat. No. 4,624,205, issued Nov. 25, 1986; Ser. Nos. 06/791,776 and 06/809,160, as it concerns the structural features of the sail, the layout features of the sail, and the various other advantages which may be gained when the structure has been designed to bear the loads in a certain fashion.

My previous applications have provided a large step forward in the development of sails such that my previous invention has found wide application for the leading edge sails, such as, for example, those used on 12 meter boats.

BRIEF DESCRIPTION OF THE PRESENT INVENTION

It has now been found that the further advantage, quite unexpected and sizable in terms of various savings associated with the elimination and/or reliance on the warp and weft technology, has produced sails of outstanding character, of light weight, and with tremendous load bearing capacity. Rather than employing the commonly used and extensively employed lamination technology where Mylar films are laminated to warp and weft woven material or various scrims of various form and the like, it has now been found that eliminating entirely the warp and weft technology achieves exceptional advantages. Thus, using only threads in the direction in which the principal forces run and approximating these force lines by threads in a novel method of forming sail panels has resulted in sizable and significant savings, not only in the material savings, but also in the cost of producing the sails, in eliminating weaving and manufacturing steps, and in eliminating the waste associated with trying to approximate prior art warp and weft woven materials to the principal force directions. If it is remembered that a sailmaker's yard of 1,000 denier Kevlar material costs over $30 per yard, and that most of it is wasted material when cutting the material for optimizing along warp thread lines (as compared to the present invention), the cost savings are tremendous.

Still further, it has now been found that custom work required on woven material to produce various panel layouts is unnecessary, as the novel panels are semi-assemblies and are fitted directly into a sail.

The panel formation is thus a part of the manufacturing process of sailmaking. Consequently, a number of steps are eliminated and the savings are achieved by using considerably less expensive bulk thread materials. These bulk thread materials are costwise a fraction of the cost for a woven material.

Still further, lamination of the thread line material is far simpler and can be done in a typical sail loft rather than requiring the separate facilities heretofore necessary for laminating materials used in the sails.

DETAILED DESCRIPTION OF THE DRAWINGS AND THE EMBODIMENTS OF THE INVENTION

Thus, with respect to the drawings herein illustrating the various embodiments and the methods for accomplishing the advantages herein, and wherein:

FIG. 1 illustrates in a plan view a typical jib sail;

FIG. 2 shows in an isometric view a frame used for forming a panel component of the sail shown in FIG. 1;

Figure 4:
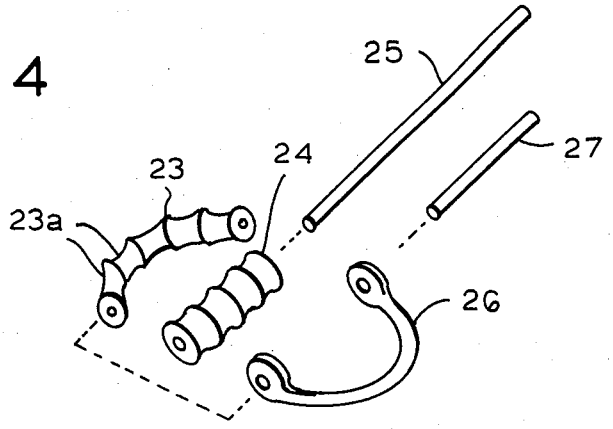
Figure 4A:
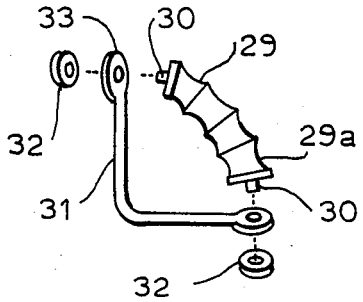
Figure 4B:
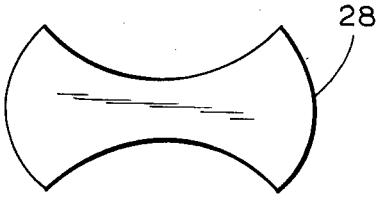

FIG. 2*a* illustrates a detail of the frame shown in FIG. 2;

FIG. 3 illustrates a tack component panel as an example of a component panel for a sail shown in FIG. 1;

FIG. 4 shows an assembly drawing and variations thereof of a device used as a clew cringle;

FIG. 4*a* shows a device used as a tack ring or tack cringle for the novel sail shown in FIG. 1;

FIG. 4*b* illustrates a cushioning device used with the devices shown in FIGS. 4 and 4*a;*

Figure 4C:
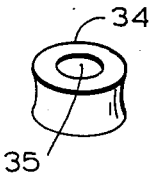
Figure 4D:
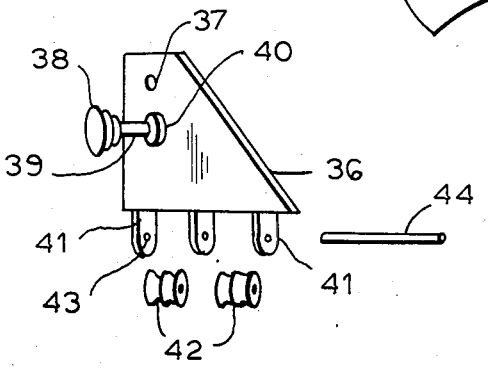
Figure 6:
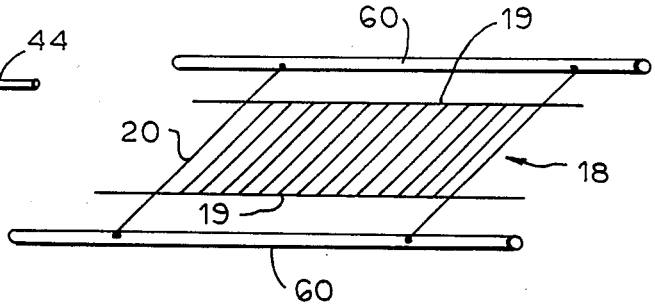
Figure 5:
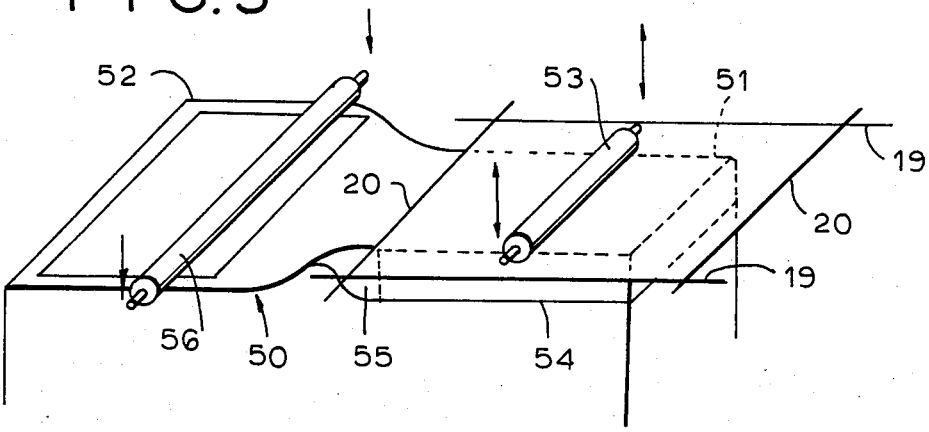
Figure 7:
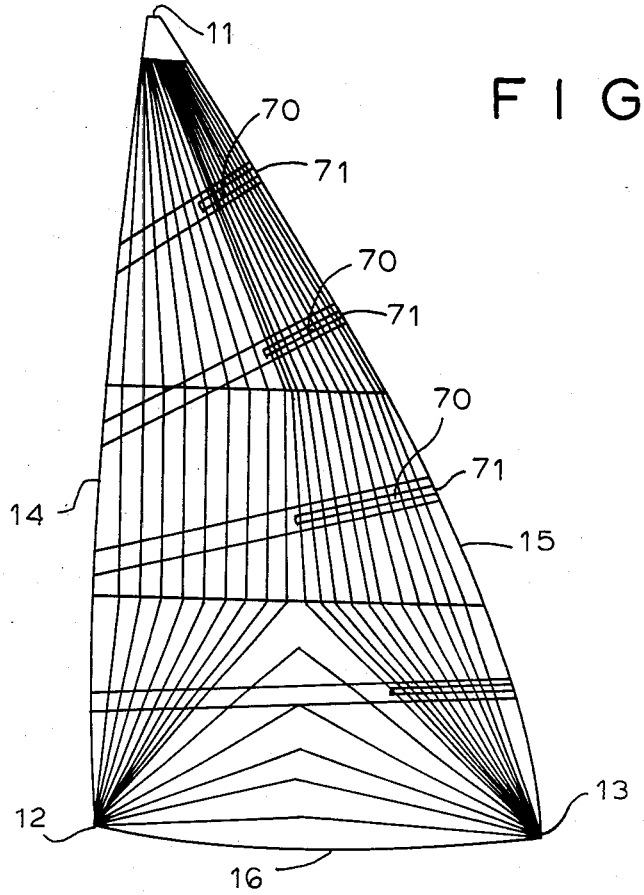
Figure 8:
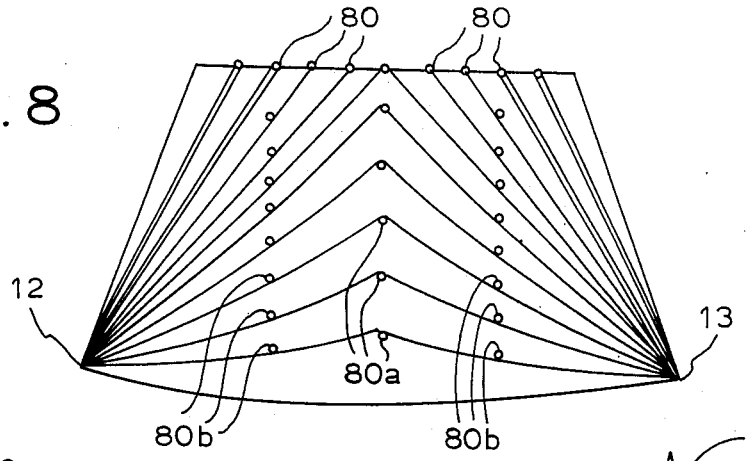
Figure 9:
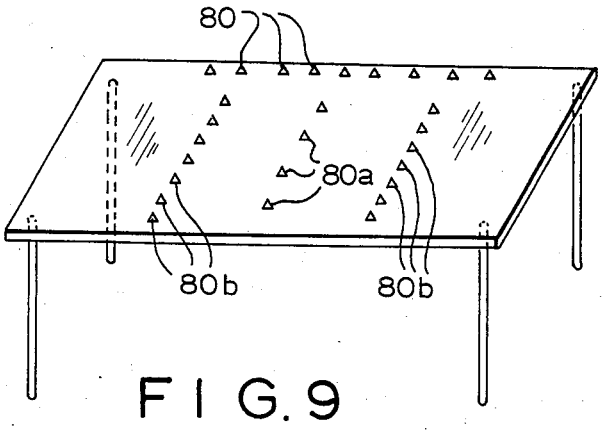
Figure 9A:
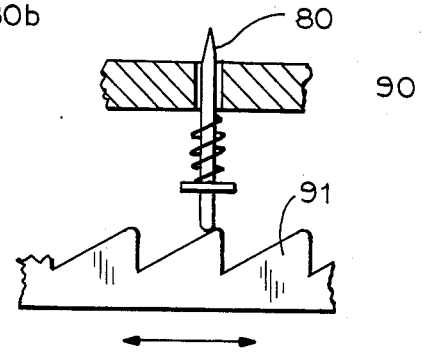

FIG. 4*c* shows another embodiment for a clew or tack ring for the novel sails disclosed herein;

FIG. 4*d* illustrates a headboard used for a mainsail shown in FIG. 7;

FIG. 5 illustrates a two-stage laminating table with a frame such as shown in FIG. 2;

FIG. 6 illustrates a conveyor assembly for a frame and for forming a laminating assembly used with respect to a laminating table such as shown in FIG. 5;

FIG. 7 illustrates a mainsail constructed in accordance with the present invention;

FIG. 8 illustrates a further embodiment of a panel construction utilizing means for changing the direction of the threads formed in a panel with intermediary turning points inside the panel;

FIG. 9 illustrates a table which may be used both for forming the panel illustrated in FIG. 8, as well as for laminating, and FIG. 9*a* shows a detail of the laminating table of FIG. 9.

Turning now to FIG. 1, it illustrates a typical sail, such as a jib or Genoa sail, identified as 10. It has a head 11, a tack 12 and a clew 13. Its luff portion has been identified as 14 and leech as 15. It has a foot 16, and the sail may consist of a number of panels. For the embodiment shown in FIG. 1, four panels have been shown: the head panel 1; the middle panel 2; the tack panel 3, and the clew panel 4. Various panel combinations may be used to make the sail according to the present invention which, for the sake of convenience, is called a "thread line" sail because of the threads 7 within the panels. At all times the panels must have a predetermined direction in which the thread 7 in the laminate is aligned with the principal forces found by experience to be exerted on that panel used in a particular sail. These forces are well recognized and are discussed such as in my U.S. Pat. No. 4,593,639.

In order to stabilize the sail against aerodynamic loads which tend to bulge the sail, additional bias strapping in the form of grid members, identified as 17, may be used. These grid members 17 and their location as well as density and/or frequency, may be determined in the manner as previously disclosed by me in the above patent; generally the consideration for this is based on the wind range for which the sail is being used. Sails which are being used for beating to windward in heavy air will tend to have greater density and frequency of the thread lines and of the grid straps 17. Sails used in lighter weather of very light weight may be able to do entirely without the grid straps 17. However, as a safety precaution, each sail in a preferred embodiment would carry the grid straps.

Additional grid straps 17 may also be used on each individual panel depending on the local forces encountered, and such grid members 17 are shown for the tack panel 3 in FIG. 3.

The individual panels of the sails, such as the midpanel 2 in FIG. 1 or any other rectangular or trapezoidal panel as it will be further explained herein, including the head panel, the tack panel and the clew panel, may be made on a device such as shown in FIG. 2, which is a frame 18 consisting of the long members 19 and the frame stabilizing or cross members 20. Cross members 20 may be adjustable in length, movable, and nonpivoting vis-a-vis the long members 19, or these may be pivoting around the pivot points 21 so as to provide a tenter frame facilitating the thread alignment. When necessary to make large sails with various sections, the length of the members 19 and 20 may be varied as necessary. For a single panel such as panel #2, the appropriate adjustments for each of the legs may be readily made by providing multiple attachment points on the frame members 19 and 20. For the luff section, i.e., the section of the panel along luff 14, the threads may be wound in such a manner that these are running in a different direction than the threads running along the other side of the panel, i.e., leech 15, as it is shown in FIG. 1 for the luff and leech section thereof.

As shown in FIG. 2*a*, the longitudinal members of the frame 19 (as well as cross members 20) may be appropriately shaped U-channels. On the outside of these, face exposed adhesive coated material may be affixed so that the threads may be arrested and fixed during the winding of the threads around the frame 18. In the interior of the U-channel after the completion the thread winding operation, a strip 22 of a selvage material may be drawn through, as shown in FIG. 2*a*. This material may form an additional reinforced selvage for the panel and for broadseaming the sail. The selvage material may he of a width typically required for broadseaming.

In the event the outside of the longitudinal member 19 carries no adhesive exposed material, then the selvage material 22 will serve as the material incorporated during the lamination and which allows the broadseaming necessary for formation of a sail.

In a similar manner to that shown for FIG. 2, the panel shown in FIG. 3 is being formed.

However, the winding operation now is on a frame, one corner of which serves as the focal point for all of the threads 7 running in that direction. Since the point loads on a sail are found in the head, tack and clew (and at reef locations, i.e., reef points and reef tack and clew), panel 3 in FIG. 3 illustrates especially well the advantages gained with the present sail where the thread concentration is in the point load location, i.e., tack 12, and parallels and substantially follows the stress lines and load lines encountered in the sail and as previously discussed in my above-identified U.S. Pat. No. 4,593,639. For the reef point loads and stress lines associated therewith, reef point thread lines as additional threads may be laid on top of the thread layout for a full size sail; the associated reef point hardware, i.e., cringles, may be used, the same as for the full size sail, and will be further discussed herein.

Because of the concentration of the thread 7 lines in the tack panel or in the clew panel 4 at tack 12 and clew 13, respectively, different sail hardware must be provided so that the threads bear evenly the force. All threads should be acting in a properly distributive fashion to bear the forces exerted along the lines that these threads run.

For this purpose, various novel hardware concepts have had to be developed to accomodate the techniques for winding the threads and to accomodate the various load bearing forces in such a manner that the force concentration is appropriately transmitted ultimately to the boat at the head, tack, and clew.

Thus in FIG. 4 an assembly drawing has been shown where a curved clew member 23 or a straight clew member 24 is used to wind the threads around such as shown for panel 3 in FIG. 3 or in FIG. 1 for clew 13.

Clew member 23 may be made in segments 23*a*, or it may be a straight piece such as shown in 24. These clew members may be typically made of a plastic material having the capability of not being distorted under the loads exerted on and by the threads, i.e., not being cut by the threads. Alternatively, these members 23 or 24 may be made in segmented or straight portions from a material such as aluminum or other corrosion-resistant materials preferably of very light weight so that the flogging of the clew tends not to injure the crew or cause damage to the rigging.

A shaft 25 shown in FIG. 4 may be inserted in the straight member 24 to form a side of the frame and to hold the clew member 24 in a permanent position while the winding operation is taking place. As the various segmented portions of clew members 23 and 24 are preferably grooved, the threads 7 are thus prevented from migrating from one side of the clew member 24 to the other.

After the completion of the winding operation and/or lamination, the clew is finished with an appropriate bail 26 for which a bail pin 27 is being used.

As it will be further discussed in connection with FIG. 4*a*, the segmented members 23*a* may have already a bail pin in these for permanent joining with the bale 26. However, for the straight member 24, a bail pin 27 is preferable.

If necessary, as shown in FIG. 4*b*, a butterfly-shaped member made of a cushioning material 28, e.g., a fabric, film or leather, may be used to distribute further the forces exerted on the clew members 23 or 24. Cushioning material 28 is wrapped around members 23, 24 or 29 prior to wrapping the threads around these. The same approach may be used for the tack and for the head.

In FIG. 4*a*, a curved tack member 29 has been shown. This tack member 29 likewise may be of either a single plastic material or one segmented in segments 29*a*, as shown in FIG. 4*a*.

A pin 30 used as part of the frame member, the ends of which may be further extended during the winding operation, is the place for the tack bail 31 at the ends thereof. Appropriate fastening means 32, such as a threaded locking nut or any other suitable device such as C-rings and the like, may be used for that purpose, including means such as a set screw in the bail eye 33 inserted in the end of the pin 30.

The device shown in FIG. 4*a* thus bears the same forces which a cringle or a D-ring typically bear in the sail, yet allows the formation of the thread line pattern necessary for a tack 12 or a clew 13, respectively.

In FIG. 4*c*, another embodiment for forming a tack or a clew has been shown in the form of a grooved ferrule 34. It may also be of a sheavelike shape and forms directly the head, the tack, or the clew cringle. However, since the groove may not accomodate as many threads as may be necessary for some sails, the device shown in FIG. 4*c* may be typically used for smaller sails and/or sails that have fewer threads, i.e., for sails used for light weather purposes.

For the device shown in FIG. 4*c*, as the ferrule 34 is then used as a cringle, the hole 35 serves the same purpose as the bail 26 or 31, that is, to attach the sheets or to place it on a tack fitting.

Ferrule 34, of course, lies in the plane of the sail and thus provides another point around which the threads are being wound in the formation of a sail, but now only in an X and Y direction (unless a half twist is given to it during the thread winding).

The frame type of method of winding the threads around the same of course requires an X, Y and Z control of the thread lines as it will be further explained herein in discussing the various methods of forming the sail of the present invention.

Turning now to FIG. 4*d*, it illustrates a headboard device 36 which is being used as a means for the sail, e.g., as shown in FIG. 7 for the head thereof.

Typically the headboard size is limited by the racing rules, and even for cruising purposes most headboards are made of the same size.

The headboard carries a hoisting hole 37 used for the shackle for hoisting the mainsail, such as in a grooved mast or on a track. The headboard slide 38 is affixed to the headboard 36 by a strapping 39 which runs between the headboard hole 40 therefor.

At the bottom of the headboard, appropriate half twisted members 41, formed as part of the headboard or separately attached thereto, may be used in combination with the grooved headboard cringle members 42 to attach the head panel to the headboard 36.

These half twisted members carry an aperture 43 therein, and a pin 44 is placed as a shaft both in the headboard cringle members 42 and the half twist members 41.

Other like attachments may be used, including such as shown in FIG. 4*c* where the size of the sail and/or weight of the sail does not demand as large a number of threads running over the headboard cringle members 42.

Turning now to FIG. 3, it illustrates the tack panel, i.e., panel #3. The techniques of the formation for this panel are also applicable for the head panel #1 or for the clew panel #4 and are depicted thereby. The threads 7 as these are wound around the tack device shown in FIG. 4*a*, are typically wound on a frame 18 which may be made of the adjustable members such as shown in FIG. 2 as 19 and 20 and configured according to the particular panel configuration needed. Thus various sail sizes require the panels to be of different sizes which then are appropriately formed. It is to be understood that the frame need not be rectangular; triangular frames and multisided frames are included.

In order to wind the threads on the panel, the devices which are typically used are those commonly found in the art, such as in the art of filament wound containers and fuel tanks used such as for lightweight purposes, i.e., fuel tanks being carried on passenger planes and the like.

The technology of winding the filaments on a frame is fairly well known. The winding apparatus is either stationary and the frame is being rotated, or an arm called a whip arm (not shown) is used and is typically a very flexible arm such as in the form of a bent fishing rod, and it is being moved around the frame as the thread is being played out from a bobbin and wound around the frame.

A combination of these two methods, i.e., rotating the frame and/or whip arm device, are also possible, that is, where the frame is being moved either in an XY direction or in an XYZ direction and the arm likewise is being moved.

Typically microprocessor controlled movements can be used to accomplish this winding of the thread around the frames in a very efficient and mass production manner, each frame being indexed in the position for being wound and as the winding is being completed, the frame removed from the winding stage and then placed on a laminating table such as shown in FIG. 5.

In FIG. 5, a table 50 consists of two sections—a narrower section 51 and a wider section 52. The narrower section has a narrower laminating roller 53 which is capable of being moved downwardly with sufficient force to achieve lamination, as will be further explained herein. The lamination is first done on the narrow table to arrest the midsection of the panel by placing a laminating film such as Mylar, etc., on the bottom of the table 50.

A second laminating film (not shown in FIG. 5) is also placed on top of the thread containing frame 18.

The frame members 19 and 20, after the midsection of the panel has been laminated, are then removed. Preferably the leading edge of the frame, as shown on the lefthand side on frame 20, is also removed, and the laminating roll 53 may also be moved over the edge so as to facilitate the further removal of frame members 19 and 20.

Thereafter the bottom film 54 and any top film that was placed on the frame member is moved to the wider table section, including appropriately curved surfaces 55, so as to facilitate the movement of the composite onto the wider section of the table 52. Thereafter the lamination process is completed by means of the wider laminating roller 56. A sandwich construction may also be used for high stress bearing panels. Said sandwich construction comprises at least two film layers and two thread layers.

As previously explained in connection with FIG. 2*a*, a selvage material 22 may likewise be inserted in members 19 prior to its removal so as to provide for the broad seaming necessary. The lamination then again is, as previously mentioned, completed on the wider section of the table 52.

Instead of having one wide roller 56, a number of edge rolls may be used just to complete the lamination as it will become evident that various modifications in the laminating process and the laminating apparatus may be employed for the laminating process.

Turning now to FIG. 6, it illustrates a conveyor means which convey by conveyor rails 60 the frame 18 from a winding section onto the table 50 for lamination of each of the frames.

After the completion of the intial lamination on table 51, the frames are then removed in the conventional fashion, but the illustration shows the rapid method by which the material handling may be accomplished, eliminating many of the prior art steps necessary in the formation of the sailcloth, such as weaving, washing, resinating, calendering and like finishing steps.

In FIG. 7 a typical mainsail has been illustrated which has batten straps 70 thereon. These batten straps are placed on the sail after the completion of the sail and act also somewhat like the grid members 17 shown in FIG. 1. The battens themselves have been identified as 71, and these are placed within pockets formed by the batten straps 70 which may be on one or both sides of the laminated material. The battens preferably do not bear directly against the laminate or the threaded material, but are typically inserted in a batten pocket made for that purpose, as it is well known in the art.

The thread alignment for a typical mainsail shown in FIG. 7 generally runs with a greater concentration of threads along the leech 15 of the sail, as most of the forces on the mainsail are being borne by the leech. Consequently, the illustration in FIG. 7 also serves the purpose to show that the thread density may be varied, not only for the individual sails, but also for the individual panels in various locations thereof as necessarily dictated by the force diagrams which have been previously discussed in my U.S. Pat. No. 4,593,639.

FIG. 8 illustrates another embodiment of the method of forming the sails, especially as it concerns the formation of a single tack 12 and clew 13 sections. It also illustrates the point that the threads may be curved appropriately by introducing pins and like means for altering the direction of each of the individual threads. Thus, at the top of the panel shown in FIG. 8, item 80 indicates the pin locations and on which the threads may be wound and the panel formation achieved. In the interior section of the panel the pins 80*a* and 80*b* may be used to introduce different curvatures to the thread lines so as to approximate as much as possible the forces in that panel section. A greater or lesser number of pins may be used as desired and/or found necessary to achieve a smooth curve. However, as shown in FIG. 8, an entire change in direction such as of a 90 degrees change may also be readily accomplished when winding the threads around pins 80*a*. Pins in a row, such as 80*b*, may be used to introduce slighter changes in direction.

For purposes of forming a panel as shown in FIG. 8, a forming table 90, as shown in FIG. 9, may be used with few of the pins 80, 80*a* and 80*b* being illustrated on table 90. Any desired number and location of pins are suggested.

In order to laminate in one operation a material (not shown), such as light Dacron tafetta or a lighter weight woven material (not shown), it may be placed on the table and the pins, e.g., 80, 80*b*, etc., driven through this woven material 80 such as by rolling with a sponge-covered roll (not shown). Thereafter the threads are wrapped around these pins, such as from the clew and the tack going to the midpoint pins 80*a*.

If necessary, the tack and clew fittings such as shown in FIGS. 4 to 4*d*, may be half twisted to facilitate the winding, and the winding completed on the table 90 with the material underneath the threads. Thereafter, by placing on the pins an appropriate laminating material with an adhesive thereon, the pins may be removed by using a cam 91. (A locked cam follower in the cam 91 and the pin 80 may be used but is not shown.) The pins may also be depressed in conjunction with the movement of the roll and the cam 91, as shown in FIG. 9*a* where the cam 91 allows the pins to recede and to be moved in one direction and to be lifted when moved in the other direction. Individually operated pins, e.g., by a solenoid and associated with, e.g., computer control for elevation and retraction, may also be used. Thus an appropriate laminate may be formed on table 90.

Turning now to the materials which are useful for the intended purpose as the thread material, the following high strength materials are useful, for example: Kevlar; Kevlar wrapped with Dacron (for adhesion purposes); a polyolefin bulk polymerized thread material sold by Allied Company of Morristown, New Jersey, under its trademark "Spectra" (wrapped with Dacron and the like thread); mixtures of the foregoing, that is, Spectra and Kevlar; high tenacity carbon fibers (if necessary, wrapped with Dacron material and other fibers mixed therewith); high strength Dacron material; polyamides, i.e., nylon; etc. These materials may range from a denier value of 400 to 5000 for the threads. Typically a 200 to 3,000 denier, or more often 2,000 denier material, may be used.

High strength polyfilament materials having very low stretch ratios such as are available in various mixtures and materials are useful. Likewise composite filaments having a core of one type, such as Kevlar and a cover of another type such as polyester, and the like, are within the contemplation of this invention.

Among the polyesters, these are readily available from a number of companies and come in a wide variety of types and polymer base materials. Likewise nylon materials (polyamides) may be used for different sails such as spinnakers for forming very high strength spinnaker material which is then laminated to a suitable nylon base material. Spinnakers are typically made of nylon, but it may have additional strapping thereon so as to improve the leech and luff properties, allowing greater useful wind range. Again, many of these materials have been described in my prior U.S. Pat. No. 4,593,639, which patent is incorporated by reference herein. For definitions of the structural members or grid members (also called secondary structural members), reference is made to this patent (these are disclosed therein, e.g., as 24 or 31, etc.).

The denier of the material may be as suited for the particular sail, starting with the smallest deniers that are being used, such as for spinnaker materials, e.g., used in the lightest weight spinnaker, through the very heavy denier material used in heavy weather sails, such as for the No. 4 or No. 5 jibs used on maxiboats where the denier weights may be up to 2,000 deniers and higher. However, typically the material runs from about 200 to about 3,000 deniers, such as for the Kevlar materials, the Spectra, and the like.

Typically Mylar film is being used directly on the threads; it is a polyester base material and exhibits thickness from 0.0005 to 0.005. Other similar material is Melinex, which is likewise a polyester base film. As the threads on the thread material may be wrapped with Dacron and the like, adhesion is improved to a Mylar film. The wrapping thus is typically with a polyester material for a polyester film. Further, multifilament and monofilament materials may be employed as thread material.

Monofilament materials, if properly formed, may have the desired combination of tenacity and lack of elasticity. These materials are readily available.

Consequently, fairly heavy denier material may then be used in the sail, thus further improving the properties of the sail. As likewise mentioned before, composite fibers, that is, where the inner sheath is of one material and the outer material is of another type, may be employed. These are often called "composite fibers" or "duplex fibers", and may be employed not only for their properties, but also for their adhesion characteristics.

Still further, nylon type materials, that is, polyamide materials of various types which are now fairly prominently found, can be used, especially for the composite formations for lightweight sails such as the lightest weight sails being used for very light wind conditions, that is, at less than five knots.

As likewise indicated in the discussion concerning FIG. 9, a lightweight material may also be used as one side of the composite or even on both sides with the threads being inbetween. Thus, the Mylar film may be on the other side, another or same fabric on the other side or a Mylar film on one side and, e.g., a Tedlar film on the other. Still further, the Mylar film may be covered with a light tafetta material the threads of which are of approximate deniers varying from 70*d*–440*d* on one or both sides.

Further, for very heavily stressed sections, i.e., a clew, multilayer panels may be made, i.e., a sandwich composite of more than one layer of threads, film, and/or light fabric.

If a lightweight material is being used, it generally serves as a further means to stabilize the threads in their locations. The Mylar film laminate adheringly confines the threads between the lightweight material and the film in the end laminate. The foregoing also illustrates the use of mixed film; film and fabric composites, and fabric-fabric composites with the threads being inbetween.

Of course, besides Mylar, other film material is films such as Kapton, etc., have shown considerable improvements, the usefulness of these is still somewhat limited by the flexual life properties of these films.

In addition to the films mentioned above, the polyethylene films are likewise available such as the bulk polymerized polyethylene films made into suitable film material.

Polyurethane films are likewise usable, and materials such as Halar films and the previously mentioned Melanix films may be employed.

With respect to the other fibers, these may likewise be of more exotic nature, such as S-glass; carbon fibers; typically wrapped carbon fibers wrapped, e.g., in polyester material and the like. Of course, composite fibers may likewise be employed, that is, composites of Kevlar and Dacron or Kevlar-carbon fiber and Dacron and the like.

With respect to the formation of the sails, as mentioned in connection with FIGS. 2 and 2*a*, the selvage material may be used for purposes of sewing the panels together as well as for purposes of forming broad seams, that is, curvatures in the panels which then allow the imparting to the sail of the necessary complex curvature. Broadseaming is especially desirable, because the panel shaping can then be done with these novel panel materials by taking the seams apart, because when the seams are sewn in an overlapping fashion without adhesives being interposed, the sail then takes its shape which can be altered, depending on the behaviour of the sail.

However, typically also these sails for the lighter weight material may be glued without any selvage material, such as 22 shown in FIG. 2*a*. The adhesively coated selvage which has been wrapped around the longitudinal member 19 in FIG. 2 may likewise be used as selvage material. The selvage material may be used along any of the edges of the frame being used for that particular purpose, and thus the width of the selvage material is appropriately pre-determined as found necessary for a particular sail.

Likewise, the seams where each of the panels join may further be improved by putting across the same adhesively adhered to strips of reinforcing material, as disclosed in my above-mentioned patent.

As shown in FIG. 1, the grid members 17 or any other reinforcing members may be placed on the thread material before its lamination or on the sail after the lamination. If placed before the lamination across the threads, the adhesively treated material further helps to stabilize the threads so that these will not move before these are being laminated and kept in place upon lamination.

Grid members 17 may be a bundle of threads, a cloth strip of various widths, or a combination of these. The size of said location of the grid strip, wind range for the sail, and materials determine the size of the grid strip. Typically these grid members are made of Kevlar in the preferred embodiment, except for nylon for spinnakers.

As shown in FIG. 7, the leech area may further be stabilized by additional threads and/or structural members as previously taught by me in my above patent, including placing entirely across the sail the batten straps 70 which hold the batten pockets in their place. Likewise for the clew, cringle or clew members, such as shown in FIG. 4*a*, these may be further protected from abrasion against the rigging by sewing on or gluing on various protective covering materials, e.g., leather.

Although the size of the panels has been shown to occupy a considerable area of the sail, smaller and differently organized panels may be used such as for the clew, tack or head, and thereafter additional panels introduced in any desired number based on the desire to vary the weight and/or the density of the threads in a particular panel. Various panel layouts have been disclosed in the art, and the present invention takes advantage of any panel layout that may be suggested, but with great advantage in material savings, weight considerations, and strength properties.

If necessary, along the luff and the leech additional selvage may be provided for the luff tape or the leech tape to be incorporated in the sail.

Although for frames the thread has been indicated to be primarily wound in one direction, further winding of same or additional, and/or different threads may be employed in various orientations across the primary lines of threads as previously discussed above, e.g., for reef points.

Based on the above description, various benefits for the above invention become evident, such as the reduced loss of material; the thread line alignment is far more easily achieved, and complex computer programs need not be developed for panel cutting and panel alignment. The wastage, of course, is sizably reduced, and the material incorporated in the sail has been decreased. The sails may now be made of lighter material such as the previously mentioned Spectra 900 or Spectra 1000 or any other derivatives which provide considerable improvements in weight and/or behavior. For example, the Spectra materials are so light as to float, yet at the same time these are entirely water repellent as these are polyolefin base materials.

Lighter thread line composite materials thus result which can now take most of the stress in the direction in which the tensioning forces bear on the threads in the use of the sail. The weft thread problems are eliminated, such as elongation, bent fiber elongation, or post weaving heat treatment. In essence, the sail is working with the threads only along the force lines (with the thread line not running off the panel as it is in the conventionally made sails), yet working in the strongest direction of the thread.

Inasmuch as weaving and weaving operation associated problems have been eliminated and finishing of the fabric is no longer necessary for the entire sailmaking process, considerable capital and labor savings are realized.

Based on the above disclosure, thus the present invention provides a very efficient sail very much lighter than previous sails encountered, with thread lines running in the correct direction as shown by stress maps and stress contour lines known in the art. Hence, sailmaking is thus considerably improved.

What is claimed is:

1. A composite sail having a head, a tack and a clew, which in use and for an intended purpose has principal stress lines, said sail comprised of a plurality of panels, each of said panels joined to an adjacent panel therefor, each of said panels comprised of a laminate of at least two layers whereinbetween said layers nonwoven, force-bearing thread material is predeterminedly disposed along said principal stress lines for said panel in said sail.

2. The sail as defined in claim 1, wherein the predeterminedly disposed threads vary in thread count density or thread size within said panel.

3. The sail as defined in claim 1, wherein the predeterminedly disposed threads converge into point 30. load locations for said sail and said point load locations are comprised of a head, a tack or a clew.

4. The sail as defined in claim 1, wherein the sail is a jib sail.

5. The sail as defined in claim 1, wherein the sail is a mainsail.

6. The sail as defined in claim 1, wherein the sail is a spinnaker sail.

7. The sail as defined in claim 1, wherein the threads are aramid and at least one of the laminate layers is a Mylar film.

8. The sail as defined in claim 1, wherein the threads are polyester wrapped aramid or polyester wrapped bulk polymerized polylefin fibers.

9. The sail as defined in claim 1, wherein the threads are carbon fiber threads.

10. The sail as defined in claim 1, wherein the laminate for a panel is a laminate of at least a fabric, threads, and a Mylar film.

11. The sail as defined in claim 1, wherein the same is a light weather sail.

12. The sail as defined in claim 1, wherein at least one edge of a panel among said plurality of panels includes a selvage material.

13. The sail as defined in claim 1, wherein said plurality of panels include grid members.

14. The sail as defined in claim 1, wherein said laminate includes thread material and grid members between said layers.

15. The sail as defined in claim 1, wherein said plurality of panels includes structural members at least along a leech portion of said panels for said sail.

16. The sail as defined in claim 1, wherein said plurality of panels include broadseams between each adjacent panel.

17. The sail as defined in claim 1, wherein high stress bearing panels include a panel for a head, a panel for a tack and a panel for a clew, and at least one such panel is of a sandwich construction comprising at least two film layers and two thread layers.

* * * * *

REEXAMINATION CERTIFICATE (1359th)

United States Patent [19]

Conrad

[11] B1 4,708,080

[45] Certificate Issued Sep. 25, 1990

[54] COMPOSITE THREAD LINE SAILS

[75] Inventor: Peter G. Conrad, Old Lyme, Conn.

[73] Assignee: CTL, Inc.

Reexamination Request:
No. 90/001,795, Jun. 22, 1989

Reexamination Certificate for:

| | |
|---|---|
| Patent No.: | **4,708,080** |
| Issued: | **Nov. 24, 1987** |
| Appl. No.: | **873,188** |
| Filed: | **Jun. 11, 1986** |

[51] Int. Cl.[5] ..... B63H 9/06

[52] U.S. Cl. ..... 114/103; 114/113; 428/293; 428/294

[58] Field of Search ..... 114/103

[56] References Cited

U.S. PATENT DOCUMENTS

| | | | |
|---|---|---|---|
| 2,589,203 | 3/1952 | Nilsen | 114/103 |
| 3,602,180 | 8/1971 | Holmes | 114/107 |
| 3,954,076 | 5/1976 | Fracker | 114/103 |
| 4,679,519 | 7/1987 | Linville | 114/103 |
| 4,702,190 | 10/1987 | Conrad | 114/103 |

FOREIGN PATENT DOCUMENTS

| | | |
|---|---|---|
| 056657 | 7/1982 | European Pat. Off. . |
| 224729 | 6/1987 | European Pat. Off. . |
| 1149799 | 12/1957 | France . |

OTHER PUBLICATIONS

"Genesis, The Latest in Bespoke Sails from Sobstad", Barry Pickthall, Seahorse International Yacht Racing, Jun. 1989, pp. 38–44.

"In the Market for a Genoa", Douglas Logan, Sailing World, pp. 62–66, May 1989.

"Race in the NOODI", Newport, Aug. 16–19, 1989.

Milgram, Jerome H., The Design and Construction of Yacht Sails, S. B., Massachusetts Institute of Technology, Cambridge, Mass. (1961).

*Primary Examiner*—Sherman Basinger

[57] ABSTRACT

Sails made with threads running in the direction of principal stresses in a laminate made of the threads laminated to a film material, such as Mylar.

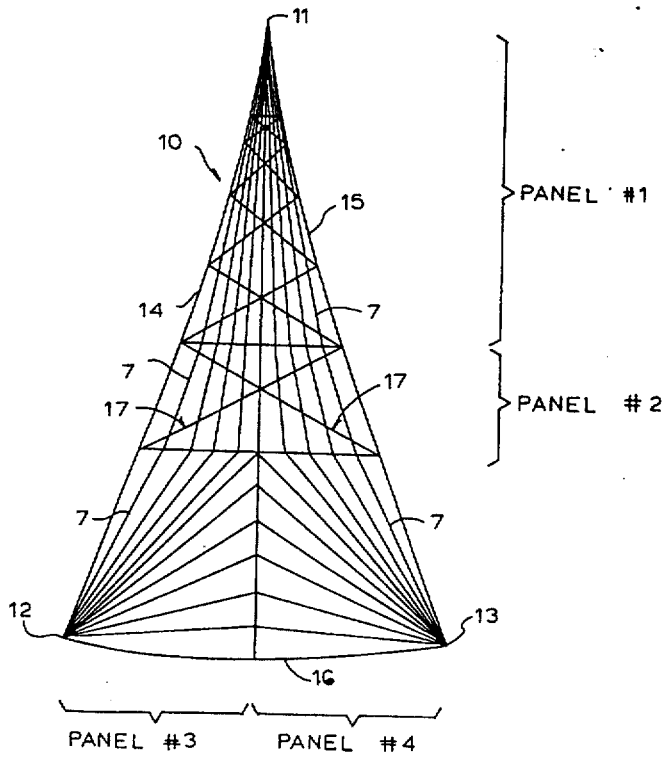

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1, 2, 4–11, 16 & 17 is confirmed.

Claims 3, 12–15 are determined to be patentable as amended.

New claims 18–30 are added and determined to be patentable.

3. The sail as defined in claim 1, wherein the predeterminedly disposed threads converge into point [30.1] load locations for said sail and said point load locations are comprised of a head, a tack or a clew.

12. The sail as defined in claim 1, wherein at least one edge of a panel *adjoining another* of a panel among said plurality of panels includes a selvage material.

13. The sail as defined in claim 1, wherein said plurality of panels include grid members *across a panel from luff to leech and from leech to luff.*

14. The sail as defined in claim 1, wherein said laminate includes thread material and grid members between said layers *and wherein said grid members run from luff to leech and from leech to luff across a panel.*

15. The sail as defined in claim 1, wherein said plurality of panels includes structural members at least along a leech portion of said panels for said sail *and interior to said panels for said sail.*

*18. The sail as defined in claim 1, wherein a plurality of panels have seams therefor substantially parallel to the foot of the sail.*

*19. The sail as defined in claim 1, wherein said sail is comprised of a number of panels wherein said panels have seams between adjoining panels substantially parallel to the foot of said sail substantially from luff to leech.*

*20. The sail as defined in claim 1, wherein said sail is comprised of a number of panels with only seams for joining each panel to adjacent panel with said seams substantially parallel to the foot of said sail and from leech to luff.*

*21. The sail as defined in claim 1, wherein in said plurality of panels each panel comprises thread material predeterminedly disposed in said panel with said thread material in each panel having substantially all of said thread material in a non-parallel relationship.*

*22. The sail as defined in claim 1, wherein said plurality of panels comprises said thread material predeterminedly disposed in said panels with said thread material oppositely oriented at luff versus at leech.*

*23. The sail as defined in claim 1, wherein said plurality of panels comprise said thread material predeterminedly disposed in said panel along said principal stress lines for said panel in said sail and wherein said sail is comprised of panels having only seams substantially parallel to a foot of said sail and from luff to leech of said sail and wherein said panels for such sail are without any interior subpanels.*

*24. The sail as defined in claim 1, wherein said plurality of panels include only broadseams between each adjacent panel.*

*25. A composite sail having a head, a tack and a clew in which in use and for an intended purpose has principal stress lines, said sail comprised of a plurality of panels, said panels joined to an adjacent panel therefor, said panels comprised of a laminate of at least two layers whereinbetween said layers primary, nonwoven force-bearing thread material is predeterminedly disposed along said principal stress lines for said panel in said sail and wherein in said panel said primary thread material is substantially entirely in non-parallel relationship.*

*26. The sail as defined in claim 1, wherein at least one of the laminate layers is Tedlar.*

*27. The sail as defined in claim 1 wherein said sail comprises a plurality of panels each specific panel of said plurality of panels comprised of a laminate whereinbetween said laminate layers for each specific panel in said sail force-bearing primary threads are predeterminedly disposed along principal stress lines for said sail wherein said specific panel is located in said sai.*

*28. The sail as defined in claim 27 wherein the predeterminedly disposed force-bearing threads are differently oriented to each other at luff and at leech for each of said plurality of sail panels in said sail along said principal stress direction for said luff and said leech for said panel in said sail.*

*29. The sail as defined in claim 28, wherein said predeterminedly disposed force-bearing thread concentration is greater in said leech area of said specific panel for said sail along said principal stress lines for said specific panel in said sail.*

*30. The sail as defined in claim 27 wherein for a specific panel threads are also disposed across said primary threads for said panel.*

* * * * *